US010512806B2

(12) United States Patent
Briscoe et al.

(10) Patent No.: US 10,512,806 B2
(45) Date of Patent: Dec. 24, 2019

(54) FIRE SUPPRESSION SYSTEM

(71) Applicant: KNOX FIRE AND SECURITY LIMITED, London (GB)

(72) Inventors: Guy Briscoe, London (GB); William Brackfield, London (GB)

(73) Assignee: Knox Fire and Security Limited, London (GB)

( * ) Notice: Subject to any disclaimer, the term of this patent is extended or adjusted under 35 U.S.C. 154(b) by 0 days.

(21) Appl. No.: 15/520,029

(22) PCT Filed: Oct. 20, 2015

(86) PCT No.: PCT/GB2015/053133

§ 371 (c)(1),
(2) Date: Apr. 18, 2017

(87) PCT Pub. No.: WO2016/063045

PCT Pub. Date: Apr. 28, 2016

(65) Prior Publication Data

US 2017/0326391 A1 Nov. 16, 2017

(30) Foreign Application Priority Data

Oct. 20, 2014 (GB) ..... 1418605

(51) Int. Cl.

| | |
|---|---|
| ***A62C 31/05*** | (2006.01) |
| ***A62C 31/02*** | (2006.01) |
| *A62C 37/11* | (2006.01) |
| *A62C 37/14* | (2006.01) |
| *A62C 37/20* | (2006.01) |

(52) U.S. Cl.
CPC ..... *A62C 31/05* (2013.01); *A62C 31/02* (2013.01); *A62C 37/11* (2013.01); *A62C 37/14* (2013.01); *A62C 37/20* (2013.01)

(58) Field of Classification Search
CPC ..... A62C 31/05; A62C 37/11; A62C 37/20
USPC ..... 239/448; 169/57, 58
See application file for complete search history.

(56) References Cited

U.S. PATENT DOCUMENTS 1,468,009 A * 9/1923 Eastman ..... A62C 37/08 169/41
2,025,782 A * 12/1935 Lawrence ..... A62C 37/12 169/41

(Continued)

FOREIGN PATENT DOCUMENTS

| | | | |
|---|---|---|---|
| GB | 2390018 | A | 12/2003 |
| JP | 2013192752 | A | 9/2013 |
| WO | 2004094000 | A1 | 11/2004 |

OTHER PUBLICATIONS

Korey, Contractor Resources, Industrial News and Information, Misc, "What's the Difference Between PVC and CPVC Pipe," Aug. 15, 2017, https://www.commercial-industrial-supply.com/resource-center/whats-the-difference-between-pvc-and-cpvc-pipe/.*

(Continued)

*Primary Examiner* — Chee-Chong Lee
(74) *Attorney, Agent, or Firm* — Shumaker & Sieffert, P.A.

(57) ABSTRACT

A fire suppression system comprising a polymer housing and an internal channel arranged to communicate a fluid from a fluid inlet to a fluid outlet. The fluid outlet is in the form of at least one aperture extending through a portion of the polymer housing into said channel.

24 Claims, 11 Drawing Sheets

(56) References Cited

U.S. PATENT DOCUMENTS

| | | | | | |
|---|---|---|---|---|---|
| 2,497,286 | A * | 2/1950 | Ashcraft | A62C 35/605 | 169/26 |
| 2,580,810 | A * | 1/1952 | Mathis | A62C 35/605 | 169/26 |
| 2,749,993 | A * | 6/1956 | Gregg | A62C 13/003 | 169/26 |
| 3,253,657 | A * | 5/1966 | Job | A62C 37/14 | 169/38 |
| 3,713,491 | A * | 1/1973 | Grabowski | A62C 13/00 | 169/28 |
| 3,811,511 | A * | 5/1974 | McCulloch | A62C 35/08 | 169/28 |
| 5,967,239 | A | 10/1999 | Sprakel et al. | | |
| 2014/0262357 | A1 | 9/2014 | Ringer | | |

OTHER PUBLICATIONS

International Search Report and Written Opinion for counterpart PCT Application No. PCT/GB2015/053133, dated Feb. 15, 2016 (17 pgs.).

* cited by examiner

FIRE SUPPRESSION SYSTEM

This application is a U.S. national phase application under 37 U.S.C. § 371 of International Application No. PCT/GB2015/053133 filed on Oct. 20, 2015, which claims priority to GB Application No. 1418605.0 filed Oct. 20, 2014. The entire contents of each of PCT/GB2015/053133 and GB Application No. 1418605.0 are incorporated herein by reference.

TECHNICAL FIELD

The present invention relates to a fire suppression system and apparatus. Particularly, but not exclusively, the invention is concerned with fire suppression in domestic or similar environments.

BACKGROUND

Legal regulations often require fire suppression systems to be installed in public buildings, offices, hotels and the like. These systems form part of the construction phase of a building where high pressure pipework is installed connecting a source of high pressure water or other suppressant to a number of discharge nozzles distributed throughout the building. The pipework can be conveniently installed with the other services such as water, electrical wiring, air conditioning ducts during the construction of the building. A suitable control system is then installed on completion of the building together with ceiling panels to conceal the fire suppression system pipework. Thus, the suppression system is largely concealed and all that the eventual building user sees is the discharge nozzles in each room and possibly fire detectors.

Conventional fire suppression systems are inherently suitable for large buildings such as offices and, as described above, can be conveniently installed. However, there is also demand for a domestic solution to fire in residential homes or other smaller property where installing the conventional pipework and ancillary equipment is either prohibitively expensive or technically unfeasible because of the nature of domestic building construction.

The present invention provides a system that can be installed in a domestic or similar environment. Furthermore, the system can be conveniently retro-fitted and furthermore suppress a fire in a manner that causes least damage to the property and contents.

SUMMARY OF THE INVENTION

According to a first aspect there is provided a fire suppression nozzle, said nozzle comprising a polymer housing containing a channel arranged to communicate a fluid from a fluid inlet to a fluid outlet, said channel comprising a closure member operable to move between a first position where the channel is obstructed such that fluid cannot be communicated to the fluid outlet and a second position where fluid can be communicated to the fluid outlet, and wherein the fluid outlet is in the form of at least one aperture extending through a portion of the polymer housing into said channel.

Such a fire suppression nozzle is advantageously substantially simpler in construction and has a much lower mass than conventional fire sprinklers.

Advantageously the polymer may be made from ABS (Acrylonitrile Butadiene Styrene) and comprises a V0 fire retardant additive. Depending on the application other additives may also be included such as colourants. Advantageously such a colourant additive may have glow in the dark properties and thus allow the nozzle to be located in a smoke filled room.

The inventors have established that a construction and manufacture of a fire suppression nozzle according to the invention allows for convenient manufacturing using injection moulding and/or additive manufacturing techniques. The integration of the fluid outlet apertures within the polymer housing reduces manufacturing time, enhances the simplicity of the product and improves reliability, not least by reducing the total number of parts to form the fire suppression nozzle.

It will be understood that conventional sprinkler heads are metal assemblies manufactured to extremely tight tolerances.

The invention not only improves reliability and reduces manufacturing costs but it importantly provides a lightweight fire suppression system. In a domestic application the support brackets needed to support the nozzles are substantially reduced and may in fact be dispensed with all together. For example the nozzle may be coupled directly to the ceiling plasterboard. The system also allows for small diameter push-fit tube fittings with flexible tubing to be used which greatly increases the simplicity of installation. This thereby reduces costs further and makes a fire suppression system for a domestic application feasible.

It also conveniently facilitates retro-fitting of the system to existing properties which may for example be required as safety regulations change and become more stringent.

The fire suppression nozzle is connected to a pressurised fluid supply which is typically a domestic water supply. The supply pipes extend from a suitable pump or pressure vessel to each of the distributed nozzles. When a nozzle is activated the pressure in the system drives the water along the supply lines and through the fire suppression nozzles to suppress or extinguish the fire.

The nozzles each comprise a closure member in the form of a plunger in a cylindrical channel with a seal extending around the plunger. The closure member is conveniently prevented from moving from the first to the second position by a heat sensitive member. This represents a 'primed' or 'ready' state of each nozzle.

The heat sensitive member may for example be a heat sensitive member such as a frangible bulb adapted to fracture at a predetermined temperature and complying with a standard such as EN12259/FM2000/UL199/LPS1039/Kofeis 0501. Standard bulbs are available each with a different temperature rating i.e. the bulb will fracture at or around a predetermine temperature. Advantageous the bulb may be predetermined to fracture at a temperature such as 57° C.

Water is prevented from leaking from the nozzle by a seal arranged around the plunger (within the channel) and in contact with the inner surface of the channel. Thus, a water tight seal can be provided. The seal may be conveniently seated within a circumferentially extending recess formed around said plunger. The plunger itself may be an injection moulded part thereby still further reducing weight.

The heat sensitive bulb is arranged such that it prevents fluid reaching the outlet. The closure member has a first end in fluid communication with the fluid inlet (i.e. the water inlet to the nozzle assembly) and an opposing end adapted to engage with a first end of a heat sensitive bulb. The nozzle is provided with an opposing abutment portion against which a second end of a heat sensitive bulb can abut. The bulb has sufficient strength to resist the movement of the closure member from a closed position to an open position; the bias being caused by the water or fluid pressure in the supply pipework.

The nozzle may conveniently be adapted such that the abutment portion is releasable from the nozzle to allow for assembly/replacement of the heat sensitive member. Thus, the nozzle can be reused after being activated by releasing the abutment portion and inserting a new bulb and reinstalling the abutment portion.

The nozzle may be connected to the fluid supply in any suitable manner. Advantageously the polymer housing may be provided with a threaded portion arranged to receive a coupling for fluid communication into the nozzle. The threaded portion may be an internal thread formed within a portion of the polymer housing. This may be formed as part of the injection moulding process thereby still further reducing weight.

A suitable fitting may then be screwed into the threaded portion to allow for connection of the fluid/water supply to the nozzle.

Advantageously a push-fit coupling may be screwed into the threaded portion to facilitate efficient installation as discussed above.

The nozzle arrangement is provided with a first side to which the water supply is connected. In use this side of the assembly faces into, for example, the ceiling cavity or wall. The second opposing side of the assembly is arranged in use to face into the room. This second side (opposite from the first side) comprises at least one aperture (i.e. a water aperture).

Advantageously the aperture extends from an outer surface of the second side (the side facing the room in use) through the polymer housing and intersects with the channel inside the nozzle. Thus a fluid path is provided from the channel through the polymer wall of the nozzle housing. This allows water to issue from the nozzle into a space or room when the nozzle is activated. This integration of channel, housing and outlet aperture greatly simplifies the device.

The apertures are arranged to distribute fluid/water from with the channel into the room on activation of the fire suppression system. The apertures may be simple uniform holes drilled through the polymer housing. Advantageously the use of polymer permits the formation of aperture holes to far greater barrel depths than that previously attainable for metal nozzles. This permits nozzle geometries, such as those described herein, which are far more compact than that previously attainable. Advantageously the use of longer aperture barrel depths allows for improved generation of mist.

Advantageously the apertures may be configured to create a fire suppressing mist in the room as opposed to a simple jet of water. Using a mist more thoroughly drives out air and reduces the temperature beneath the nozzle. Reducing temperature and reducing available oxygen facilitate the suppression of a fire.

The apertures may be divided into a first portion with a first radius/cross-sectional area and a second portion with a second radius or cross-sectional area, greater than the first. In effect the aperture may be stepped with two different cross-sectional areas.

Advantageously the first radius may be between 0.3 mm-1.2 mm and the second radius may be between 1 mm-3 mm. The change in diameter from the first to second diameters may be stepped or tapered. Other aperture designs are contemplated including apertures with a single radius and those with more than two radii.

Furthermore since the use of polymer allows for apertures of far greater barrel depths the apertures may be distributed or arranged in a particular, and optionally more complex, pattern to optimise the fire suppression effect for a given application. For example, at least one aperture may be formed as a single centrally located aperture surrounded by a plurality of apertures. The surrounding plurality of apertures may be equally spaced with respect to the centrally located aperture so as to generate a uniform mist extending away from the nozzle. For some applications the surrounding apertures may be organised into one or more rings. Advantageously the combination of a central aperture and one or more rings of apertures surrounding the central aperture provides a highly effective and uniform mist generating pattern.

The central aperture advantageously suppresses fire directly beneath the suppression nozzle. The centrally located aperture may thus intersect the channel perpendicularly to the inner surface of the channel and said plurality of apertures intersects the channel at an angle with respect to the inner surface of the channel.

The respective angles of the apertures may be selected for different mist ranges i.e. the desired fire suppression pattern that is required from the matrix of nozzles in the given room. Advantageously the inclusion of a central and vertically orientated aperture allows for a more effective distribution of nozzles to be used. It also advantageously provides a fire suppression nozzle to be located directly over a position of potential fire. This could for example be over a fireplace, cooker or the like or in an industrial environment.

Advantageously the respective angles of the apertures may be selected to take into account the risk profile of the room and the nozzle orientation.

Advantageously the nozzle may be constructed with the fluid inlet coaxial to the plunger for certain application such as for when the nozzle is installed in a vertical orientation. Such a coaxial arrangement allows for the profile thickness of the nozzle to be reduced yet further.

When the nozzle is activated the channel must be opened to allow fluid/water to pass through the nozzle housing to the apertures described above. This is achieved by allowing the seal surrounding the closure member to move between two positions. Advantageously a seal surrounding said closure member may be arranged so as to be positioned on a first side of the at least one aperture when the closure member is in said first position (a closed or 'primed' position) and on a second side of the at least one aperture when the closure member is in the second position (an open or activated position). Thus the seal position moves to a position that exposes the apertures which intersect with the channel wall thereby allowing the fluid to flow along the channel and escape through the apertures.

Conventional sprinkler systems use a heat sensitive bulb arranged in a vertical orientation. The housing supporting the bulb disadvantageously shields the bulb in part from the heat of a fire because each end of the bulb must be supported.

The inventors have established that adopting a horizontal orientation of bulb advantageously improves the sensitivity of the fire suppression system by exposing a greater surface of the bulb to the heat of a fire. Furthermore, supporting the bulb in a horizontal orientation removes the need for a supporting portion between the fire and the bulb. Thus, sensitivity can be improved. Still further the integrity of the bulb can be conveniently inspected.

The housing of the nozzle may thus be provided with an opening adjacent to the heat sensitive member (the bulb)

such that in use the heat sensitive member is exposed to a room. In effect the housing of the nozzle is provided with a window through which the bulb is visible. Heat within the room can thereby easily reach the bulb and, if a fire is present, the bulb can be activated more quickly than conventional sprinklers.

The nozzle assembly may be coupled to a wall or ceiling by any suitable means. Advantageously the nozzle is extremely light and hence a greater range or couplings may be used to install the nozzle. Advantageously the nozzle may be secured using simple retention springs.

Any suitable spring loaded arrangement may be used which allows the nozzle to be inserted through a hole in (for example) a plasterboard ceiling and supported from a ceiling face of the plasterboard. Advantageously two 'butterfly' type spring arms may be used wherein the arms rotate into a vertical position to allow for insertion and then rotate by means of the spring loading to engage with the plasterboard.

The distal parts of the spring may conveniently have a large radius maximising contact with the plasterboard which thus reduces pressure. This minimises the chance of damage to the plasterboard.

The nozzle may be connected by one or more rim portions around the nozzle body which can be abutted with a ceiling for example and releasably connected thereto. Advantageously the rim may be integral with the polymer housing i.e. the two parts are a single injection moulded part. This still further reduces the number of parts and facilitates installation. The nozzle may for example be in a disc shape having a first face comprising the mist generating nozzles and an opposing face onto which the inlet port and channel containing housing is formed. This may all be formed as a single injection moulded part.

Viewed from another aspect there is provided a polymer fire suppression nozzle comprising a fluid inlet, fluid channel and fluid outlet, wherein the fluid outlet is in the form of a group of apertures formed through a portion of the nozzle and intersecting with a portion of said channel, said nozzle further comprising a closure member located within said channel and operable to fluidly connect the inlet with the group of apertures.

The group may advantageously comprise at least one aperture intersecting the channel at 90 degrees to its elongate axis and at least one aperture intersecting the channel at an angle of less than 90 degrees to its elongate axis. Thus a distributed mist generating pattern is formed providing a uniform mist beneath the nozzle.

Viewed from yet another aspect there is provided a fire suppression system comprising a water source and water delivery pipework connecting the water supply to a plurality of polymer fire suppression nozzles, wherein each nozzle comprises a push-fit coupling arranged to couple the nozzle to the water delivery pipework.

Advantageously the water delivery pipework may be flexible pipework such as flexible fire retardant nylon. This further facilitates convenient installation of the system.

Viewed from a still further aspect there is provided a polymer fire suppression apparatus for delivering water into a space in response to a predetermined temperature in said space, said apparatus comprising an elongate heat activated bulb, wherein the elongate axis of said heat activated bulb is horizontal in use.

Applications of the polymer nozzle according to the invention include kitchen extraction assemblies for domestic of kitchen use or even military application such as on ships or submarines. In such applications the elongate axis of the heat activated bulb may be parallel with the surface onto which the nozzle is to be attached.

The polymer nozzles may also be used on aircraft where a weight saving is important or in shipping or yachts where space may be a consideration.

BRIEF DESCRIPTION OF THE DRAWINGS

The invention will now be described by way of example only and with reference to the following figures in which.

Figure 1:
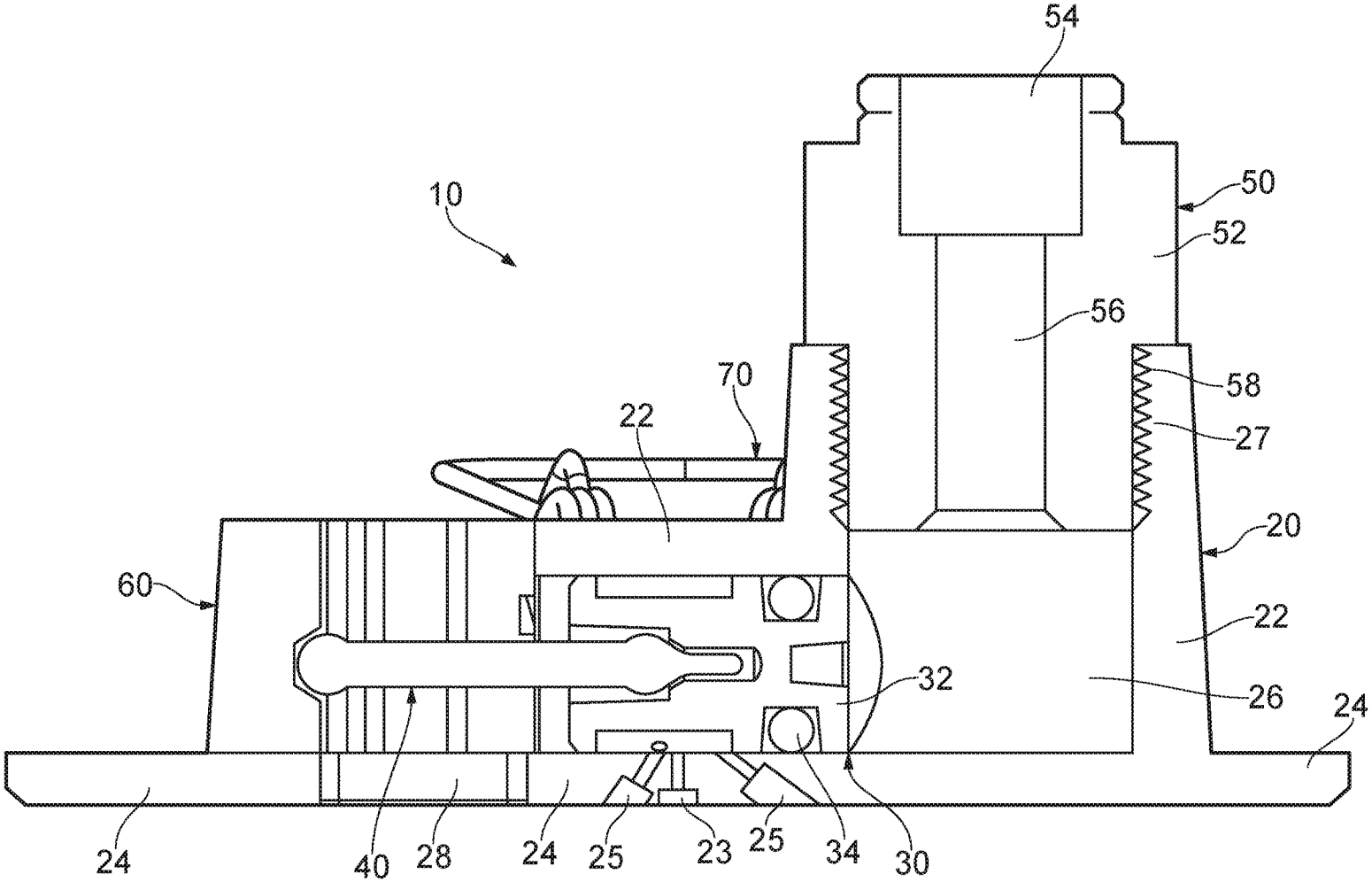
FIG. 1 is a cross-section through a polymer nozzle in a closed position according to an invention described herein.

While the invention is susceptible to various modifications and alternative forms, specific embodiments are shown by way of example in the drawings and are herein described in detail. It should be understood however that the drawings and detailed description attached hereto are not intended to limit the invention to the particular form disclosed but rather the invention is to cover all modifications, equivalents and alternatives falling within the spirit and scope of the claimed invention.

DETAILED DESCRIPTION

FIG. 1 shows a cross-section through a polymer fire suppression nozzle 10 according to an invention described herein.

The fire suppression nozzle device is formed of a single piece injection moulded housing 20. The housing contains a piston or plunger 30 located inside a water channel 26 of the housing 20; an end piece 60 which slots into the housing 20 and which defines an end of the water channel 26; a heat frangible bulb 40 located between the end piece 60 and the plunger 30. An adapter or coupling 50 is connected to the top end of the water channel 26.

The base of the housing 20 is defined by a general flat circular plate 24 (although any suitable shape may be used depending on the application). The main body 22 of the housing 20 and the raised split-ring 21 (see FIGS. 4 and 5) is located on this plate 24. Flanges 29 are located at the split portions of the split ring 21 and in-use these flanges can be engaged with a spring mounting system 70.

The main body 22 includes the water channel 26 through which water may be communicated. At the upper end of this water channel internally threaded connection 27 is provided.

This is integral with the injection moulded material. Using this internally threaded connection 27 the coupling 50 can be connected to the water channel 26. Advantageously a push-fit coupling may be used to facilitate installation.

At the centre of the plate 24 the mist generating apertures are positioned. Specifically the apertures are a plurality of integrated micro-outlets. The term integrated is intended to mean that the apertures are integral with the injection moulded body or housing i.e. they are machined or manufactured into the plastic material.

These micro-outlets include a central vertical micro-outlet 23 and a surrounding plurality of further micro-outlets 25 angled with respect to the central micro-outlet. These micro-outlets are in fluid communication with the water channel 26 i.e. the outlets extend through the housing material and intersect with the water channel 26 by penetrated the side wall of the channel.

Any suitable configuration or distribution of micro or other mist generating outlets may be used depending on the application. For example, the outlets may be distributed to provide a very narrow mist pattern, for example for use in a kitchen application or the like.

Figure 3:
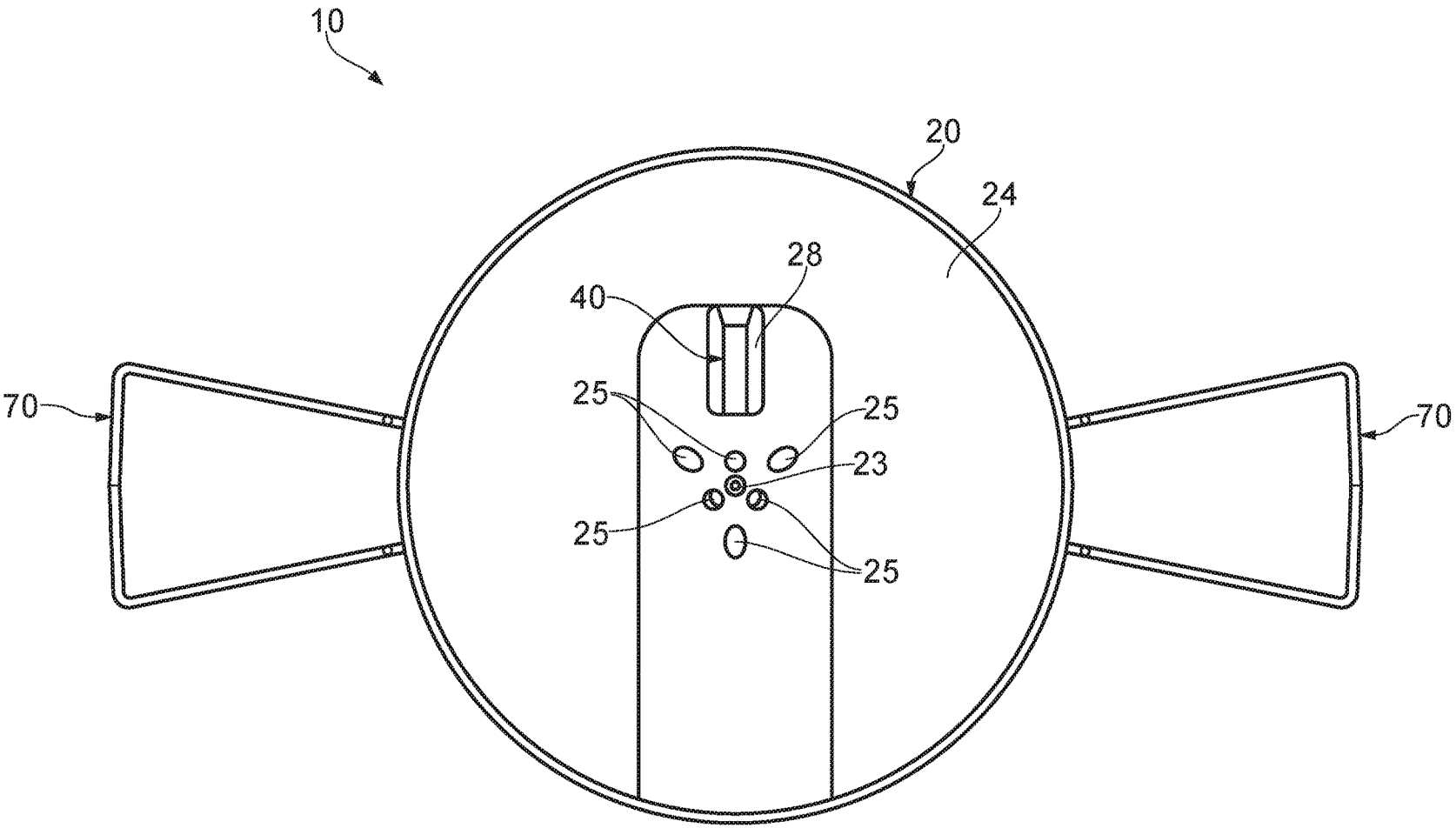
FIG. 3 is a front view of the room or space facing side of the polymer nozzle.

The housing is also provided with an opening or air channel 28 which passes through the plate 24 such that the frangible bulb 40 is, at least in part, exposed when the fire suppression device 10 is viewed from below (as shown in FIG. 3). Thus, a side portion of the heat sensitive bulb is exposed to the room or space into which the system is installed. The bulb is secured at a first end by a plunger 30 (described below) and at an opposing end by the end piece 60.

A closure member is located within the channel and is arranged to seal the channel in a first position to the right in FIG. 1 or to permit water/fluid to flow through the apparatus by movement towards the left in FIG. 1. The closure member may conveniently be a plastic cylinder and plunger much the same as a syringe, for example.

The plunger 30 is located inside the water channel 26 which has a circular cross-section. The plunger is formed of a main body 32 and an O-ring 34 seal located within a circumferential recess. The plunger may itself be injection moulded to further reduce weight and improve simplicity and reliability.

The O-ring 34 is located around the main body such the water in one section of the water channel 26 is unable to pass into the section of the water channel 26 on the opposing side of the O-ring seal.

The relationship between the O-ring position, the plunger main body 32 and the end piece 60 is such that in a 'primed' or 'ready' state (see FIG. 1) the O-ring seal is located to the right or upstream of the apertures 23, 25 i.e. the seal prevents water passing through the apertures and out of the device. This is achieved by a biasing of the plunger against the heat frangible bulb 40 which prevents movement of the plunger and thus movement of the seal over and past the apertures 23, 25. Water pressure inside the channel 26 creates the biasing force.

The coupling 50 has a main body 52, a push-fit connector 54, water channel 56 and an externally threaded connection 58. The externally threaded connection 58 is located at one end of the water channel 56 and is engaged with the internally threaded connection 27 of the housing 20. Thus a water-tight connection is formed with the chosen coupling. The coupling may be selected according to the application or the chosen pipe coupling arrangement.

The water channel 56 is located in such a manner that water can be freely communicated to the water channel 26 of the housing 20. A push-fit connector 54 may for example be provided such that a secure connection with flexible plastic tubing can be made as described below with reference to FIG. 7.

FIG. 3 is a view from underneath the nozzle showing the distribution of apertures 23, 25 and the opening 28 exposing the bulb 40. This is how the nozzle might appear in-situ when installed in a ceiling.

Figure 4:
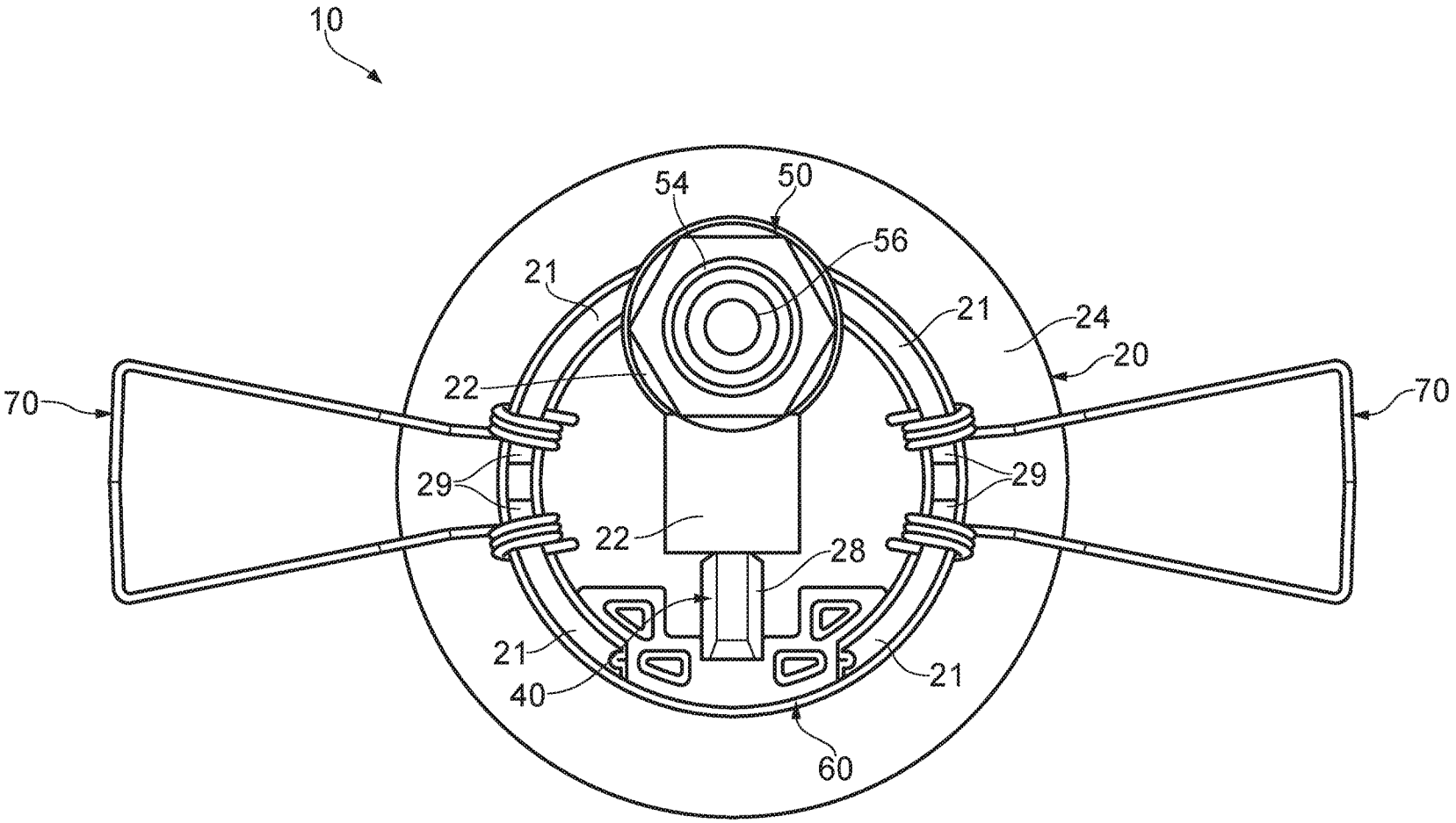
FIG. 4 is a back view of the ceiling facing side of the polymer nozzle.
Figure 5:
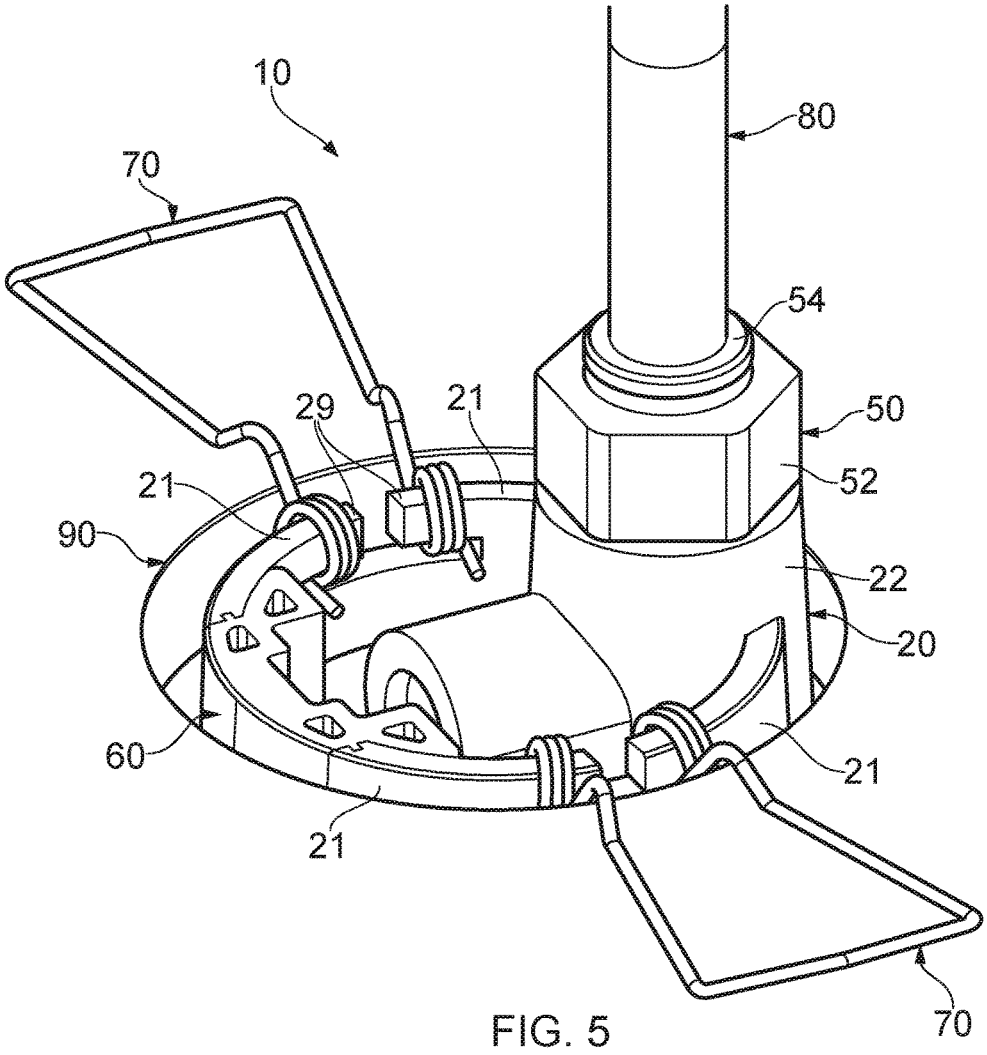
FIG. 5 is an angled back view of the ceiling facing side of the polymer nozzle.

FIG. 4 is a plan view of the nozzle arrangement of FIG. 1 with like reference numerals referring to the same integers.

Viewed from above the opening 28 around the bulb 40 can be seen. This side of the apparatus is inserted through (for example) a hole in a plasterboard ceiling 90 and secured to the plasterboard. The opening 28 exposes the bulb to the room environment beneath the nozzle and further provides a passage for any hot gas to pass through the nozzle.

Exposing the bulb in this way i.e. arranging the bulb in a horizontal position improves the exposure of the bulb to the room environment beneath the nozzle arrangement. This improves the sensitivity of the nozzle because there is nothing between the bulb and the fire as is the case with conventional fire sprinkler systems.

Returning to FIG. 1, the polymer nozzle is 'primed' or made ready for use as follows.

First, the selected bulb is located between the end of the plunger and the removable end piece 60. The end piece is moved into position and the bulb is secured in a recess formed in said end piece. The opposing end of the bulb is secured in a recess in the plunger main body 32. Pressurised water fills the channel 26 and biases the plunger against the end piece 32 putting the bulb into compression. The length of the bulb is such that the O-ring seal is located at a first position to the right of the aperture group 23, 25. Thus, pressured water is prevented from passing to the apertures.

A fire may then start in the room or space beneath the nozzle. The temperature in the room rises and hot gas begins to reach the ceiling and passes through the opening 28 surrounding the bulb.

Figure 2:
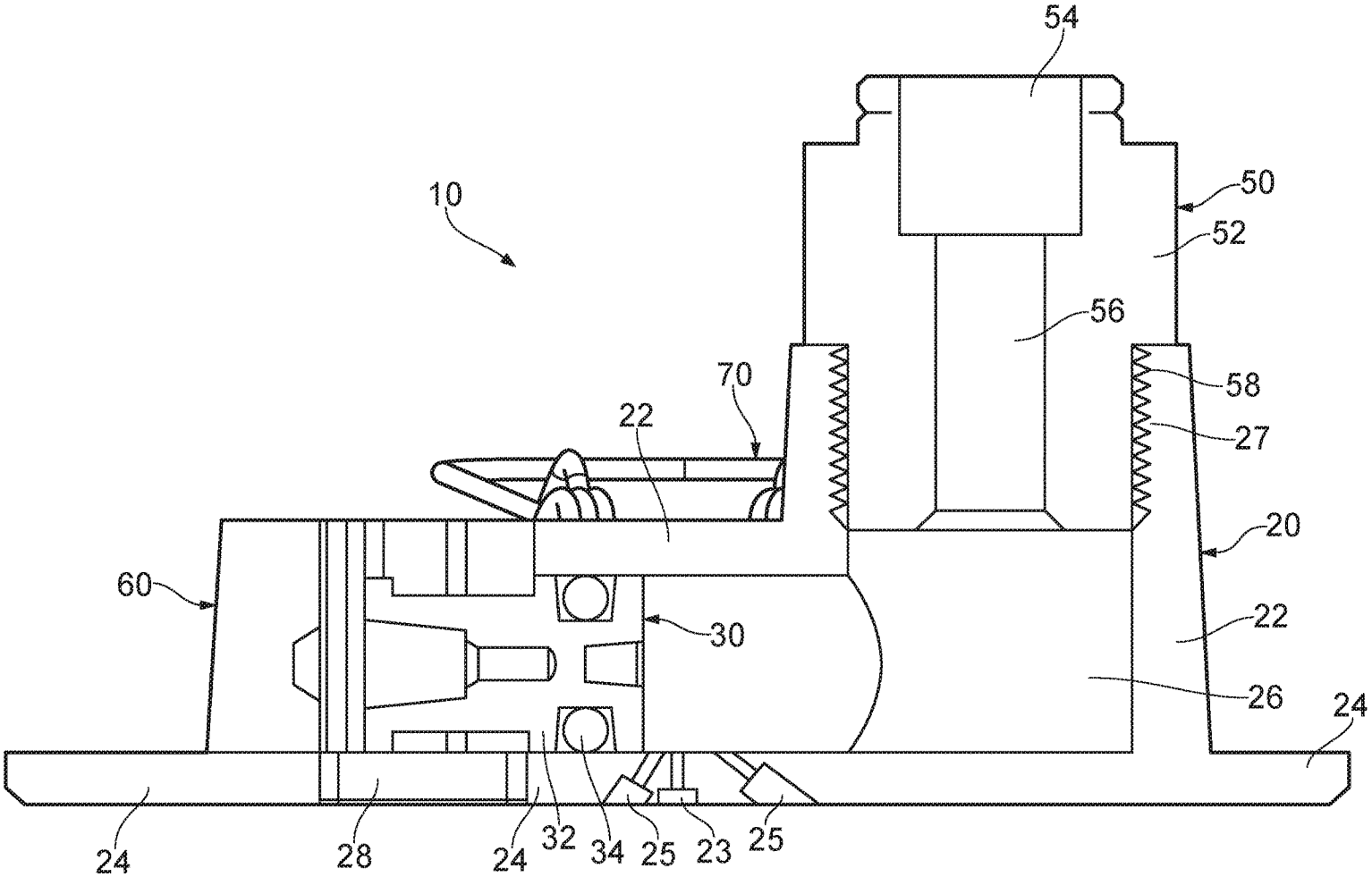
FIG. 2 is a cross-section through the polymer nozzle in an open according to an invention described herein.

At a predetermined temperature (selected according to the bulb type) the bulb breaks and the resistance that had previously prevented movement of the plunger in the channel is removed. This causes the pressurised water to force the plunger 30 to the end of the water channel 26 such that the end of the plunger 30 will abut with the piece 60 (see FIG. 2).

In this position, the O-ring 32 has now moved over and past the apertures 23, 25 and water can be freely communicated from the water channel 26 to the micro-outlets 23, 25.

The water is forced out through the micro outlets 23, 25 and is micronized creating a fine mist that is ejected into the room suppressing the fire beneath the polymer nozzle 10. Depending on the selected nozzle arrangement different mist patterns or intensities can be generated.

Figure 6:
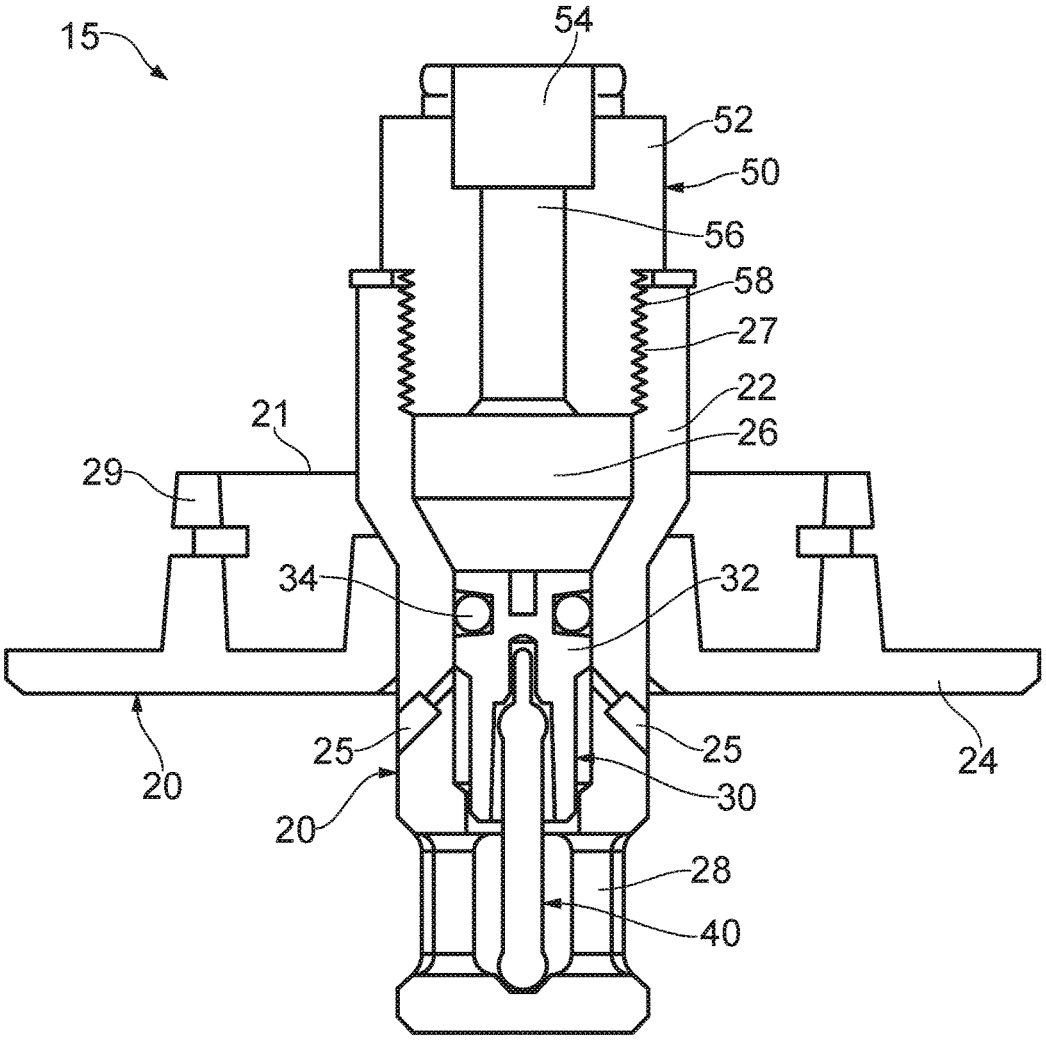
FIG. 6 is a cross-section through an alternative polymer nozzle arrangement in a closed position.

FIG. 6 shows a different embodiment of a polymer nozzle 15 according to an invention described herein. In this arrangement the bulb is in a conventional orientation i.e. in a vertical orientation. FIG. 6 shows the nozzle in a primed state.

As with the first embodiment described above the nozzle body or housing 20 is injection moulded plastic and comprises a water channel 26. In FIG. 6 the plunger arrangement and end piece are in a vertical configuration. The apertures 25 are similarly arranged to penetrate the polymer body and intersect with the water channel 26. In a primed state the O-ring seal 34 is positioned up-stream or above the aperture 25 to prevent water being discharged from the device.

The principle of operation of the arrangement in FIG. 6 is fundamentally the same. The bulb prevents movement of the plunger within the device until the bulb has broken. Water pressure in the water channel causes the plunger to move down exposing the apertures 25 and generating mist from the apertures 25.

It will be appreciated that the perimeter of the polymer nozzle may be provided with a plurality of apertures so as to create a circumferential mist pattern around the nozzle.

Figure 7:
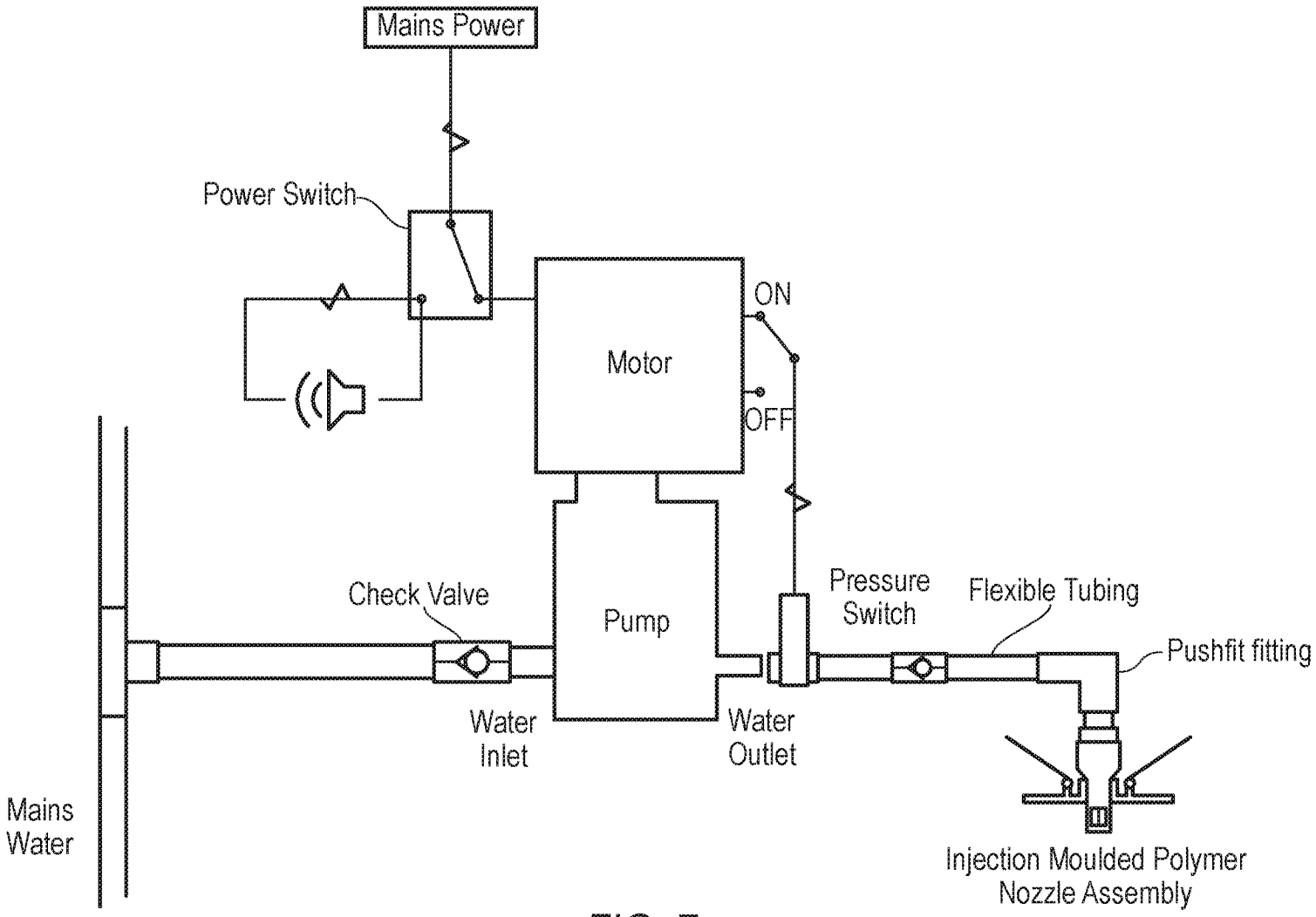
FIG. 7 is a schematic of a fire suppression system incorporating a polymer fire suppression nozzle.

FIG. 7 shows a fire suppression device 210 (as described above) integrated as part of a fire suppression system 200.

A plurality of injection moulded or additive manufactured (3D printed) nozzle assemblies 10/15 are distributed around a room or space to which the fires suppression system is to be applied.

Each polymer nozzle 10/15 is coupled to flexible tubing located within the ceiling space above, for example, the ceiling plasterboard. For example a matrix of polymer nozzle may be provided across a room at 4 m×4 m intervals.

The flexible tubing may for example be manufactured from UL94 V0 rated fire retardant semi-rigid Nylon with an inner diameter of 4.6 mm and an outer diameter of 9.6 mm.

The flexible tubing 80 is connected to the nozzle 10/15 by means of a push-fit coupling facilitating convenient installation, even in restricted spaces. Because of the low weight of the nozzles it has been established that conventional plasterboard is sufficiently strong to support the installation. Thus, overhead pipe and sprinkler support structures are not required. Furthermore, the flexible pipework can be conveniently supported or located on the plasterboard itself.

The flexible tubing connects each of the nozzles 10/15 to a pump or pressure vessel which in turn is connected to a conventional water supply or tank. The tubing may optionally include one or more non-return valves.

The system operates as follows:

A fire beneath one or more of the polymer nozzles 10/15 causes the respective bulb or bulbs to break. Pressure within the flexible tubing 80 begins to decrease as water is released from the respective water channels 26 to form a mist around the nozzle 10/15. The reduction in pressure is detected by a pressure sensor which in turn activates a pump to pressurise the system. Water is then forced through the plastic tubing to the nozzles which have been activated.

The inventors have identified that due to its adaptability such polymer fire suppression nozzles are particularly suitable for a wide variety of applications including: aircrafts; yachts; shipping; hazardous areas; server rooms; kitchens; medical; military; electrical cabinets; buses; residential homes/other domestic applications; production lines; waste processing/recycling plants and turbine halls.

Figure 8:
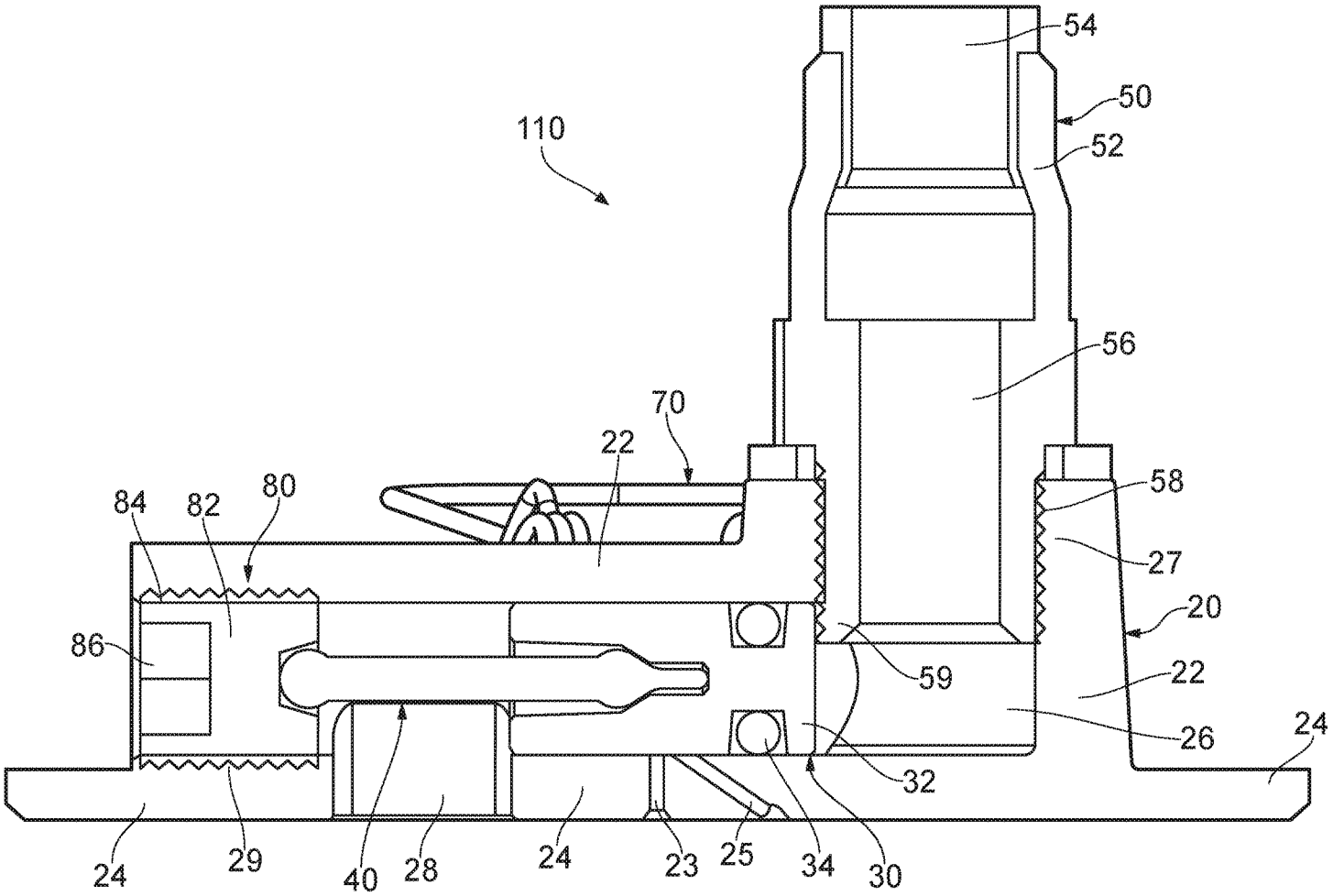
FIG. 8 is a cross-section of a modified version of the polymer nozzle depicted in FIGS. 1 to 5 in a closed position according to an invention described herein.
Figure 9:
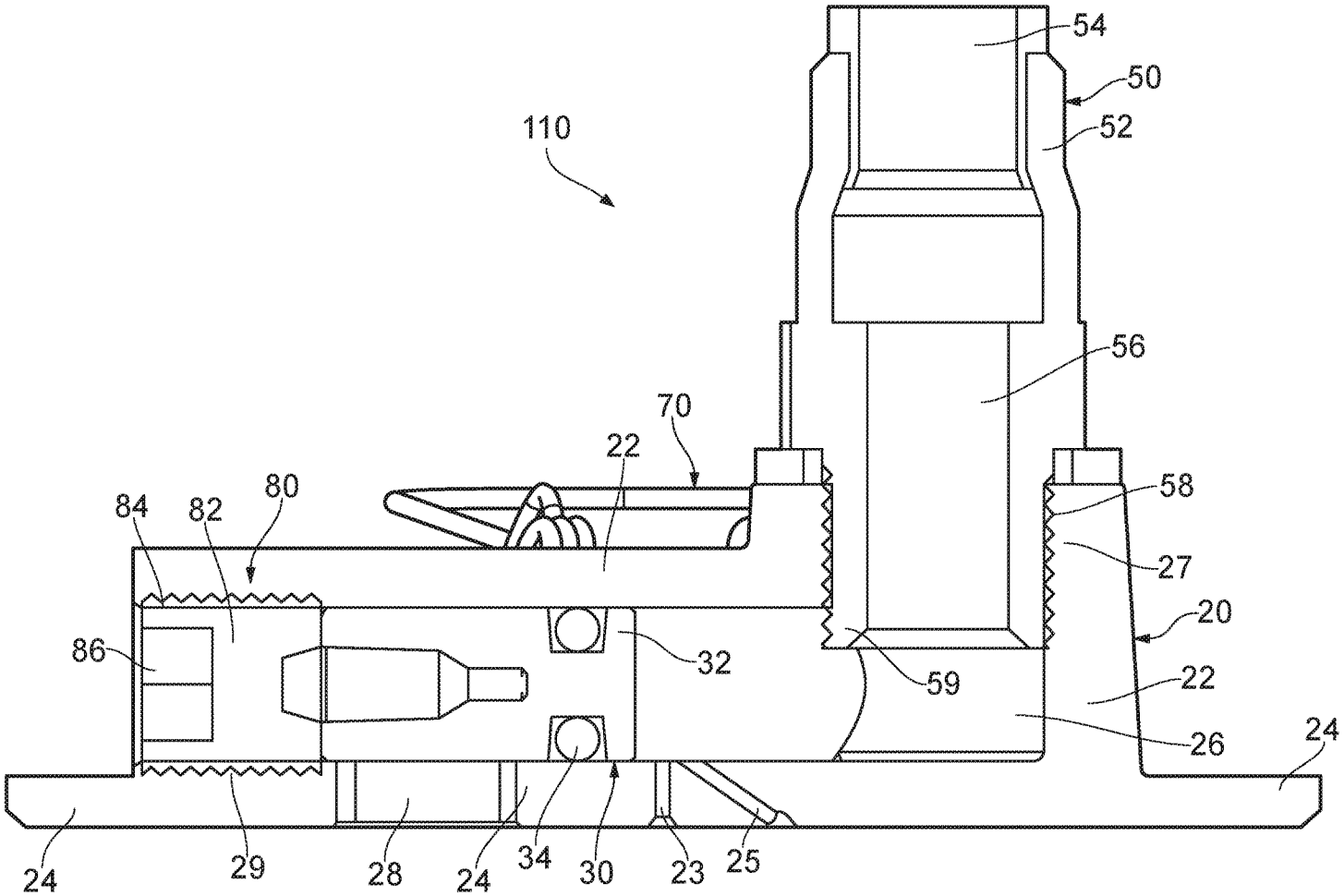
FIG. 9 is a cross-section through the modified polymer nozzle in an open position according to an invention described herein.
Figure 10:
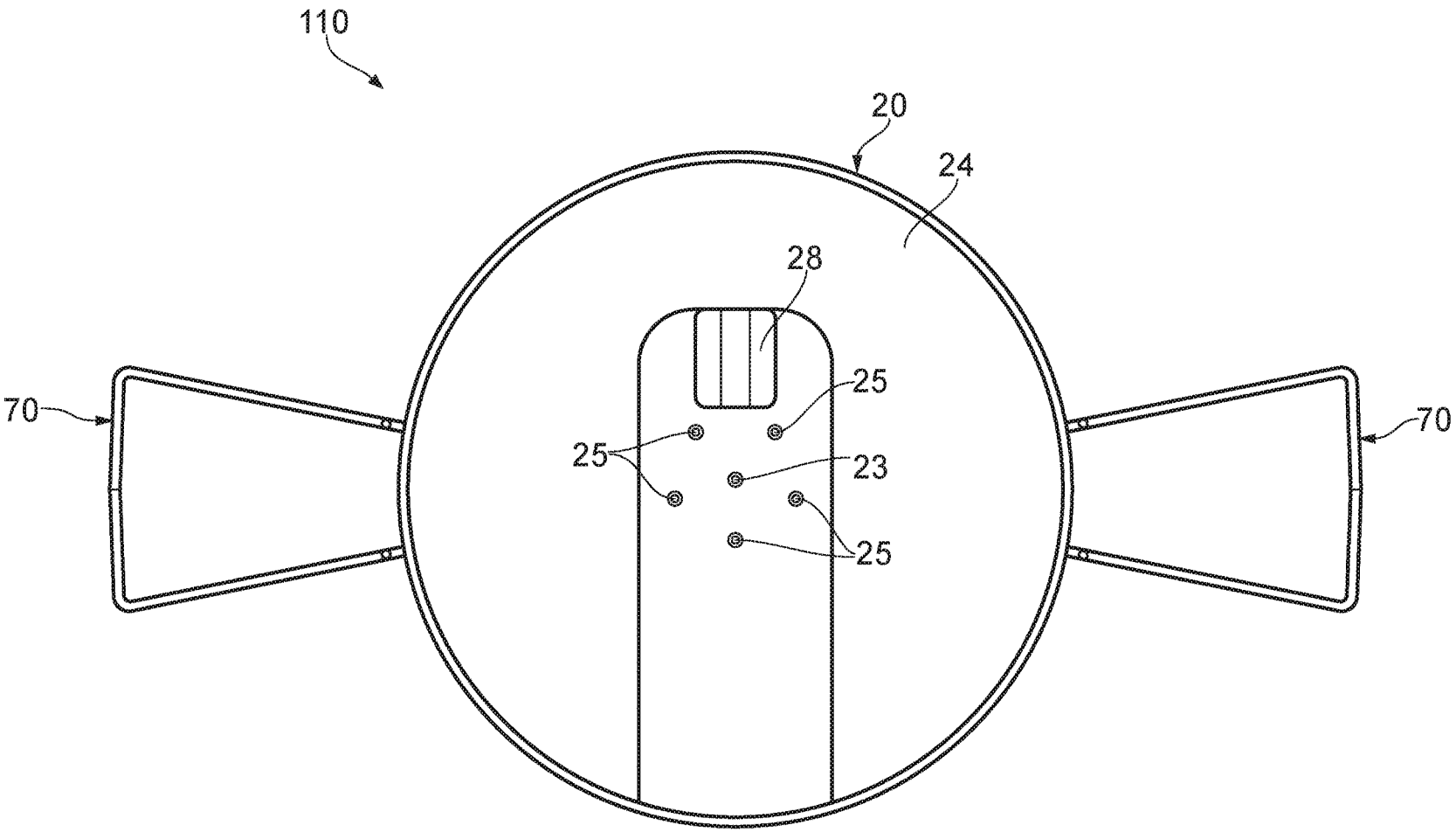
FIG. 10 is a front view of the room or space facing side of the modified polymer nozzle.
Figure 11:
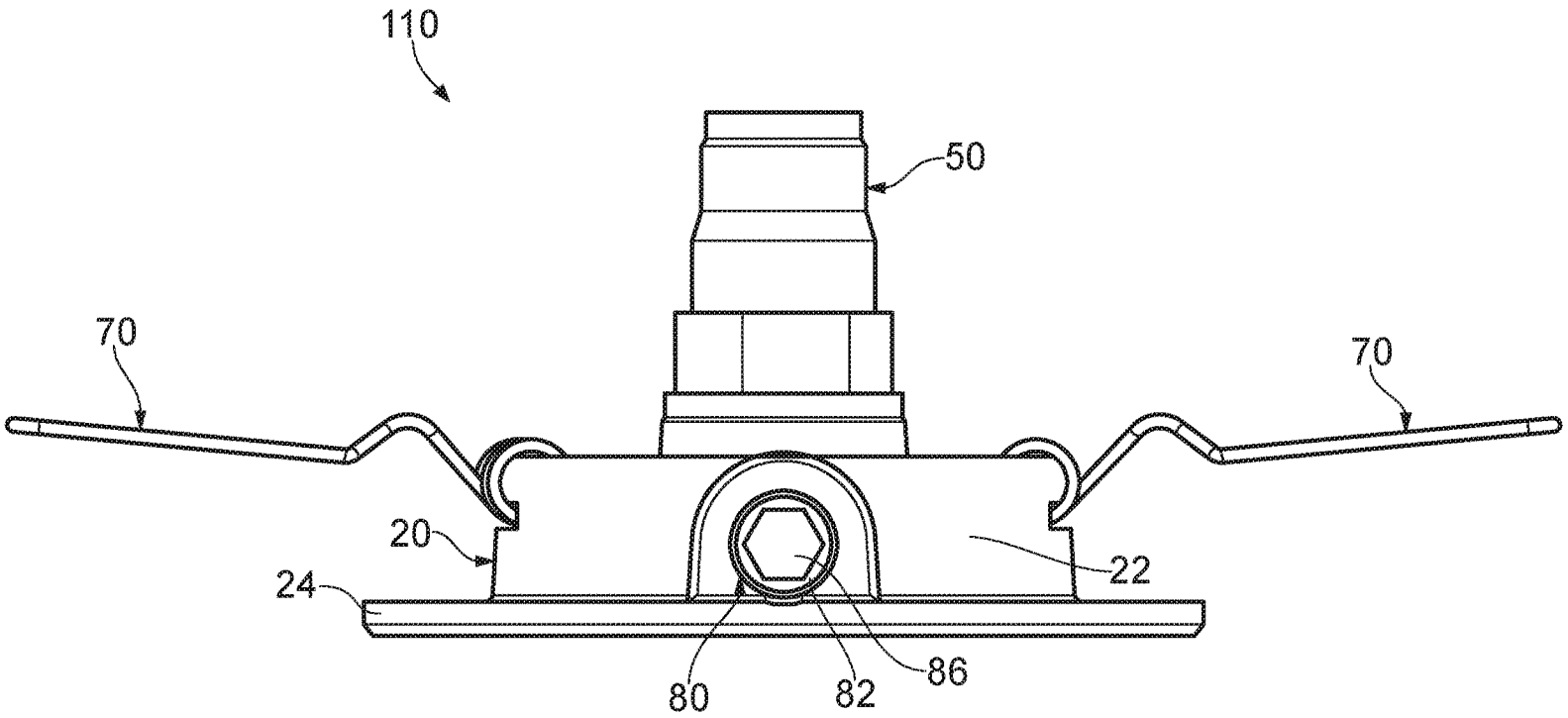
FIG. 11 is a side view of the modified polymer nozzle with an end of a bulb retaining screw visible.

FIGS. 8 to 11 show a modified version of the polymer nozzle 10 depicted in FIGS. 1 to 5 as modified polymer nozzle 110. FIG. 8 shows a cross-section through the modified polymer nozzle 110 in a closed position. FIG. 9 shows a cross-section through the modified polymer nozzle 110 in an open position. FIG. 10 shows a front view of the room or space facing side of the modified polymer nozzle 110. FIG. 11 shows a side view of the modified polymer nozzle 110 with an end of a bulb retaining screw 80 visible.

The construction and operation of polymer nozzle 110 is substantially similar to polymer nozzle 10 with like reference numerals referring to the same integers. Particular modifications and the advantages thereof will be discussed below.

As best seen in FIGS. 8, 9 and 11, end piece 60 of polymer nozzle 10, together with its corresponding slot in housing 20, has been replaced by a bulb retaining screw 80. The bulb retaining screw 80 has an externally threaded connection 84 which engages with the second internally threaded connection 29 located at the end of water channel 26. In the closed (primed) state shown in FIG. 8 the heat frangible bulb 40 is located between a recess in the main body 82 of the bulb retaining screw 80 and a recess in the main body 32 of the plunger 30.

During assembly, the heat frangible bulb 40 is inserted through the hole in the main body 22 of the housing 20 defined by the second internally threaded connection 29 and inserted into the recess in the plunger main body 32. The bulb 40 is secured by screwing the bulb retaining screw 80 into the second internally threaded connection 29. The bulb retaining screw 80 is screwed into place using an appropriate hex key in hex socket 86.

As depicted in FIG. 11 a small cut out is made in the plate 24 to allow for easy insertion of the bulb retaining screw 80. The hex socket 86 is also clearly visible in the figure. The use of the hex socket 86 allows for a fine degree of control of the pressure applied to the bulb 40. The type of screw used for the bulb retaining screw 80 may, for example, be a set screw or grub screw.

FIGS. 8 and 9 show the modified nozzle in a deactivated and activated state respectively i.e. in FIG. 9 the heat frangible bulb has broken allowing the plunger 32 to move horizontally into an open position.

As shown in FIGS. 8 and 9 the coupling 50 is modified such that a lower portion 59 of the externally threaded connection 58 extends into the water channel 26. Allowing the externally threaded connection 58 to extend into the water channel 26 provides an abutment for the plunger 30 in a deactivated position i.e. the plunger is pressed against the lower portion 59 by the heat frangible bulb 40. When heat activates the bulb 40 the plunger is moved as a result of water pressure away from the lower portion 59 so as to allow water to exit through the micro-outlets 23, 25. Such an arrangement helps to maintain the correct position of the plunger 30 during assembly and transport.

FIG. 10 shows an example of an optional alternate configuration of micro-outlets including a central vertical micro-outlet 23 and a plurality of further micro-outlets 25 angled with respect to the central micro-outlet 23.

FIGS. 8 and 9 show an example of an optional alternate configuration of the opening 28 where the opening passes through plate 24 but does not pass through the housing main body 22 above the bulb 40. Selection of the opening 28 configuration may help in setting the point at which the bulb 40 breaks by controlling the air flow around the bulb.

The invention claimed is:

1. A fire suppression nozzle configured to be mounted to a wall or a ceiling, the nozzle comprising:

a housing containing a channel arranged to communicate a fluid from a fluid inlet to a fluid outlet, the channel comprising a closure member operable to move between a first position where the channel is obstructed such that fluid cannot be communicated to the fluid outlet and a second position where fluid can be communicated to the fluid outlet, and wherein the fluid outlet is at least one aperture extending through a portion of the housing into the channel, wherein the closure member is prevented from moving from the first to the second position by a heat sensitive member, wherein the nozzle is provided with an opening adjacent to the heat sensitive member such that in use the heat sensitive member is exposed to a room, and wherein the heat sensitive member is configured to be in a horizontal orientation when in use and the opening is configured to provide a continuous passage for hot gas to pass through the nozzle.

2. The nozzle of claim 1, wherein the heat sensitive member is a bulb adapted to fracture at a predetermined temperature.

3. The nozzle of claim 1, wherein the closure member is a plunger arranged within the channel and further comprising a peripheral seal arranged to contact an inner surface of the channel.

4. The nozzle of claim 3, wherein the seal is seated within a circumferentially extending recess formed around the plunger.

5. The nozzle of claim 1, wherein the closure member has a first end in fluid communication with the fluid inlet and an opposing end adapted to engage with a first end of the heat sensitive member.

6. The nozzle of claim 5, wherein the nozzle is provided with an abutment portion against which a second end of the heat sensitive member can abut.

7. The nozzle of claim 6, wherein the abutment portion is releasable from the nozzle to allow for assembly/replacement of the heat sensitive member.

8. The nozzle of claim 1, wherein the housing is provided with a threaded portion arrangement to receive a coupling for fluid communication into the nozzle.

9. The nozzle of claim 8, wherein the threaded portion is an internal thread formed within a portion of the housing.

10. The nozzle of claim 1, wherein the nozzle comprises a first side arranged to receive a fluid supply and a second opposing side comprising the at least one aperture.

11. The nozzle of claim 10, wherein the at least one aperture extends from an outer surface of the second side through the housing and intersects with the channel.

12. The nozzle of claim 10, wherein each aperture is divided into a first portion with a first radius and a second portion with a second radius greater than the first.

13. The nozzle of claim 1, wherein the at least one aperture is formed as a single centrally located aperture surrounded by a plurality of apertures.

14. The nozzle of claim 13, wherein the plurality of apertures are equally spaced with respect to the centrally located aperture.

15. The nozzle of claim 13, wherein the centrally located aperture intersects the channel perpendicularly to the inner surface of the channel and the plurality of apertures intersect the channel at an angle with respect to an inner surface of the channel.

16. The nozzle of claim 1, wherein a seal surrounding the closure member is positioned on a first side of the at least one aperture when the closure member is in the first position and on a second side of the at least one aperture when the closure member is in the second position.

17. The nozzle of claim 1, further comprising a rim extending around the housing and arranged in use for coupling the nozzle to a wall or ceiling.

18. The nozzle of claim 17, wherein the rim comprises a polymer and is integral with the housing.

19. The nozzle of claim 17, wherein the rim is a disc surrounding and integral with the housing.

20. The nozzle of claim 1, further comprising a pair of springs arranged to connect the nozzle to a ceiling or wall.

21. The nozzle of claim 20, wherein the pair of springs comprises a pair of butterfly springs.

22. The nozzle of claim 1, wherein the fire suppression nozzle comprises a polymer fire suppression nozzle.

23. The nozzle of claim 22, wherein the polymer comprises a fire retardant additive.

24. The nozzle of claim 1, wherein the nozzle is configured to be mounted to the ceiling, and wherein the continuous passage through the nozzle comprises a continuous upward passage through the nozzle.

* * * * *